US005611449A

United States Patent [19]

Pedersen

[11] Patent Number: 5,611,449

[45] Date of Patent: Mar. 18, 1997

[54] FOLDABLE CONTAINER

[76] Inventor: Thor Pedersen, Åsgårdane, N-3550 Gol, Norway

[21] Appl. No.: 335,852

[22] PCT Filed: May 4, 1993

[86] PCT No.: PCT/SE93/00387

§ 371 Date: Nov. 9, 1994

§ 102(e) Date: Nov. 9, 1994

[87] PCT Pub. No.: WO93/23315

PCT Pub. Date: Nov. 25, 1993

[30] Foreign Application Priority Data

May 11, 1992 [SE] Sweden ..... 9201471

[51] Int. Cl.[6] ..... B65D 21/00

[52] U.S. Cl. ..... 220/6; 220/1.5

[58] Field of Search ..... 220/6, 1.5

[56] References Cited

U.S. PATENT DOCUMENTS

| | | | |
|---|---|---|---|
| 2,793,780 | 5/1957 | Walklet et al. | 220/6 |
| 2,914,210 | 11/1959 | Paston | 220/6 |
| 3,403,806 | 10/1968 | Pohl | 220/6 |
| 3,941,271 | 3/1976 | Zarges et al. | 220/6 |
| 3,999,676 | 12/1976 | Trebilcock et al. | 220/6 |
| 4,186,841 | 2/1980 | Buckley et al. | 220/1.5 X |
| 4,662,532 | 5/1987 | Anderson et al. | 220/6 X |
| 4,735,330 | 4/1988 | Hoss | 220/6 |
| 4,742,653 | 5/1988 | Napier et al. | 52/66 |

FOREIGN PATENT DOCUMENTS

| | | | |
|---|---|---|---|
| 0048577 | 3/1982 | European Pat. Off. | B65D 88/52 |
| 2147276 | 5/1985 | United Kingdom | B65D 88/52 |
| 8601788 | 3/1986 | WIPO | B65D 88/52 |

*Primary Examiner*—Steven M. Pollard
*Attorney, Agent, or Firm*—Michael D. Bednarek; Kilpatrick & Cody

[57] ABSTRACT

A foldable container comprising a floor (11), a roof (10), and at least two side-walls (12–15). Each one of the side walls (12–15) is connected with the floor (11) through link members (27) forming a connection between the edge side (20) of the floor and the lower edge side of respective side wall (12–15). The link members allow on one hand turning the wall between a horizontal position and a vertical position, and on the other hand displacing the wall in its own plane.

10 Claims, 4 Drawing Sheets

2/4

10
11
12
13
14
17
18
19
20
21
22
23
24
25
26
27
28
29
30
37
38

FOLDABLE CONTAINER

TECHNICAL FIELD

The present invention relates to a foldable container, comprising a floor, a roof and at least two side-walls, wherein a frame extends along the edge sides of the floor.

BACKGROUND ART

Foldable containers of the above described type can be used as transportation containers for various kinds of goods, as weather shelters, as storage buildings on building sites, or as quickly erectable habitable accommodations on catastrophe sites.

U.S. Pat. No. 4,742,653 describes an example of a foldable container of this type. Several more attempts have also been made to achieve such advantageous devices.

Usually these known constructions comprise a number of loose parts such as wall sections, fastening members and the like which are required for assembling the container by means of a number of tools. As an alternative the various wall elements in a container may be pivotedly connected with each other through hinges. A drawback with these hinges is that they often form bridges for heat transfer through the wall construction. Moreover these hinges are easily damaged during transportation and erection.

THE TECHNICAL PROBLEM

It is therefore a first object of the invention to provide a foldable container which is useful for the above described tasks, which container does not have any loose parts or need any fastening members for the erection and which does not have hinges which are easily damaged or other heat transferring bridges.

THE SOLUTION

For this purpose the invention is characterized in that each one of the side-walls is connected to the floor through said frame and link members, which form a connection between the frame and the bottom edge of respective side-walls, that one end of each link member is displaceable in the frame, which allows on one hand turning the wall between a horizontal position and a vertical position, and on the other hand displacing the wall in its own plane, and that the floor frame forms a side support to the side-walls, when said side-walls are erected to vertical positions.

Advantageous embodiments of the invention are disclosed in the appending sub-claims.

DESCRIPTION OF DRAWINGS

An embodiment of the invention now will be described more in detail with reference to the appending drawings, in which.

PREFERRED EMBODIMENTS

Figure 1:
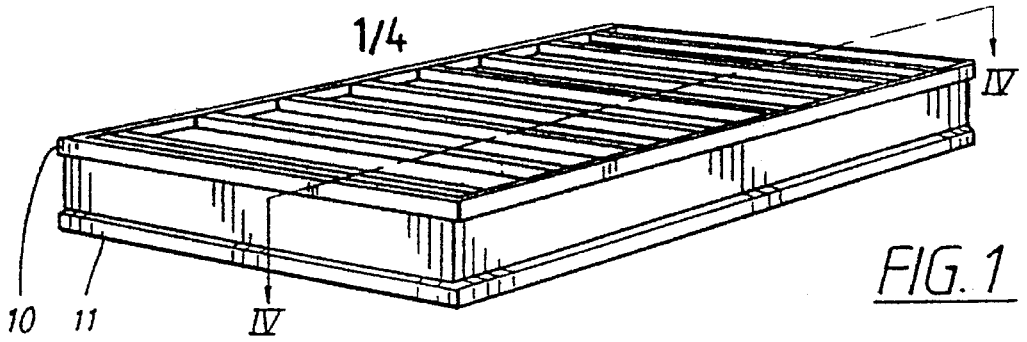
FIG. 1 shows in a perspective view a container according to the invention in its collapsed transportation state.

The collapsed conger as shown in FIG. 1 forms a complete transportation unit comprising all parts of the erected container. This transportation unit has a height of 40–60 cm and a length and a breadth which for example may correspond to the measures of a conventional ISO-container. The weight for example may be about 700 kg.

The transportation unit therefore can be stored/transported in a mode which is very space-saving. A lorry and a trailer for example can carry eight to twelve units. The transportation also can be carried out by train, boat, aircraft or helicopter.

Figure 2:
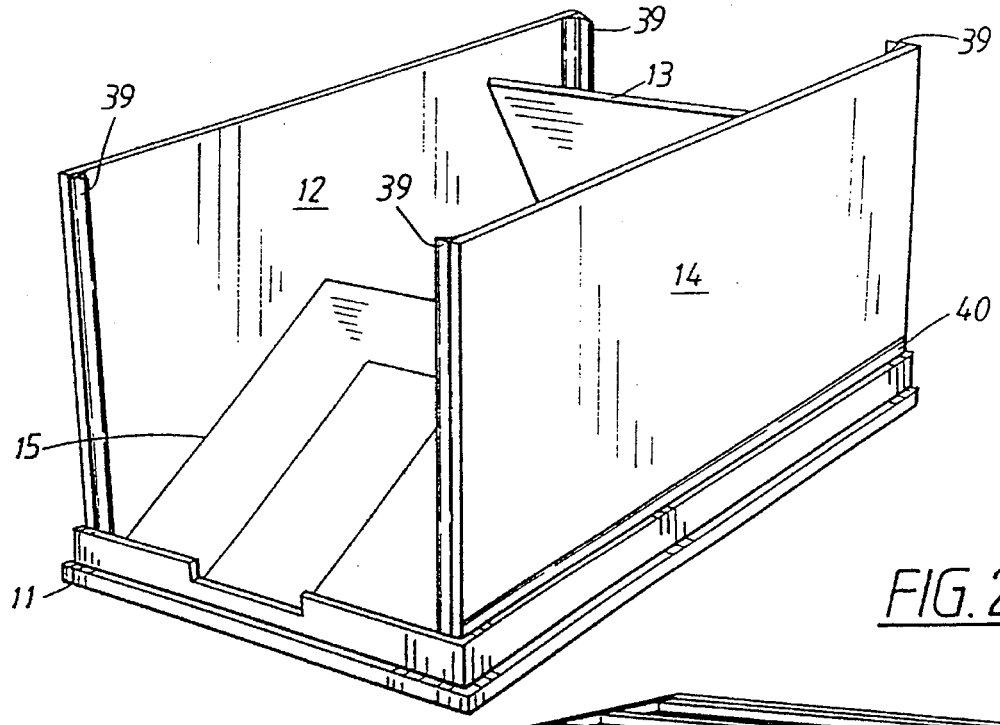
FIG. 2 shows the container in a corresponding view during erection.
Figure 3:
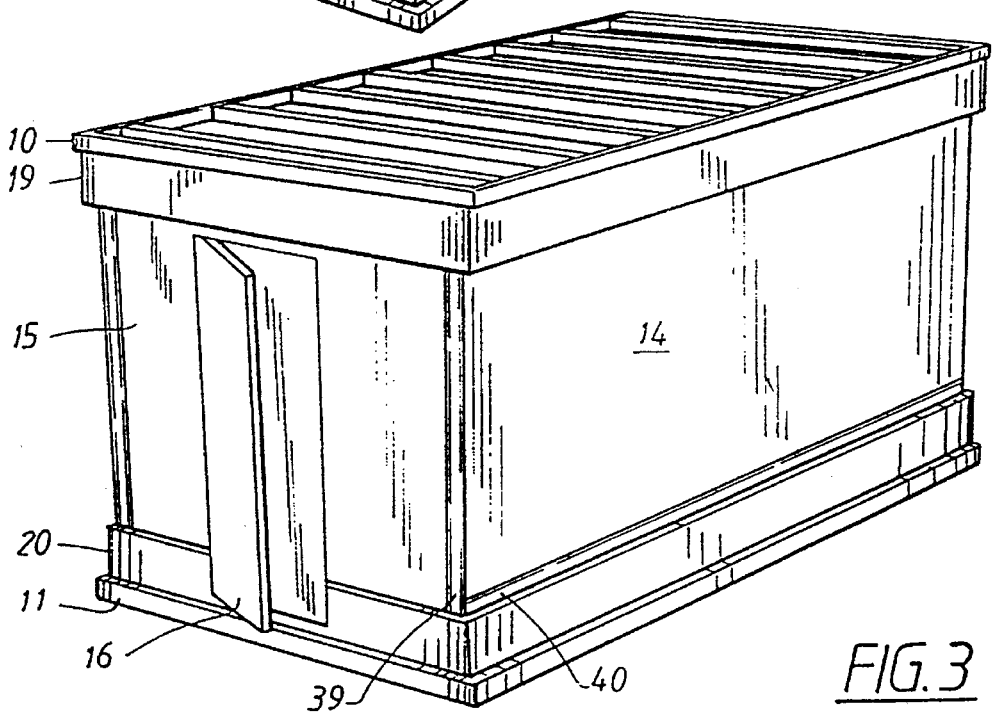
FIG. 3 shows the container after finished erection.

When the unit has arrived at its destination, the erection is carried out by means of a lifting crane. First, the cover member 10 of the unit is lifted from its bottom member 11. Thereafter the walls 12–15 are erected as shown in FIG. 2, one of these walls being provided with a door 16. Finally, the cover member is replaced to form a roof on the container as is shown in FIG. 3.

Figure 4:
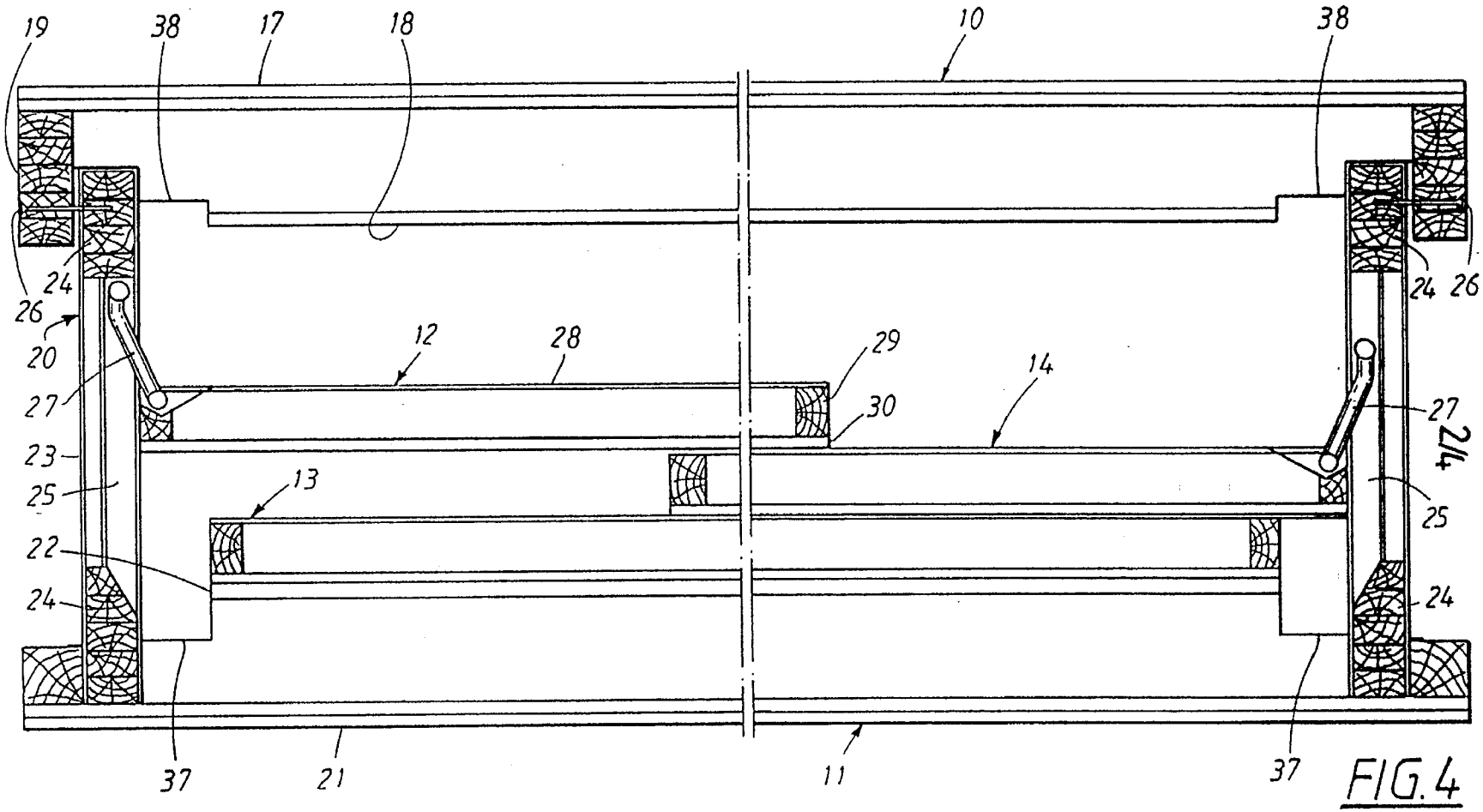
FIG. 4 is a section through the container along the line IV—IV in FIG. 1.

FIG. 4 is a section through the transportation unit at a larger scale, showing how the cover member 10 and the bottom member 11 embrace the sidewalls. The cover member 11 has an outer roofing 17, e.g. of aluminium, to keep out the weather. Inside there is a ceiling board 18 and insulation, suitable for the field of use, and a system of beams, not shown, which can take up forces, are provided in the space between the outer layers 17, 18. These construction details can be varied in many ways within the scope of the knowledge of the man skilled in the art and therefore need not be described more in detail.

A frame 19 with four sides, e.g. of glue-laminated wood, extends along the four edge sides of the roof in order to truss the roof and to protect the insulation. Further, the roof france, 19 cooperates with a corresponding four-sided frame 20 on the bottom member 11, which bottom member comprises an outer floor cover 21, e.g. of aluminium, which protects against moist from the ground. Inside there is a floor board 22 and an insulation, not shown, suitable for the field of use, and a system of beams for taking up forces is provided in the space between the outer layers 21, 22. These construction details may be varied in many ways within the scope of the knowledge of a man skilled in the art and therefore need not be described more in detail. The floor frame 20 is dimensioned such that it can be accomodated inside the roof frame 19 and comprises an outer aluminium coating 23, beams 24 of glue-laminated wood and vertical tubular rails 25. The cover member and the bottom member are secured to each other in the transportation position by means of bolts 26.

Due to the fact that the container according to the illustrated embodiment is rectangular and has a length which corresponds to at least twice the height of the walls, the two sidewalls 13, 15 may lie in the same plane and therefore need not be stacked on each other. The walls 12 and 14, which form the long sides of the container, overlap each other in the transportation unit.

All the outer walls 12–15 are connected with the floor frame 20 through a number of link members 27, each of which is rotatably pivoted with one of its ends in the edge side of the wall and is displaceably and rotatably connected with one of the tubular rails 25.

Each wall has an outer aluminium coating 28, space members 29, an inner wall board 30, and an insulation, not shown, located between the aluminium coating and the wall board.

Figure 5:
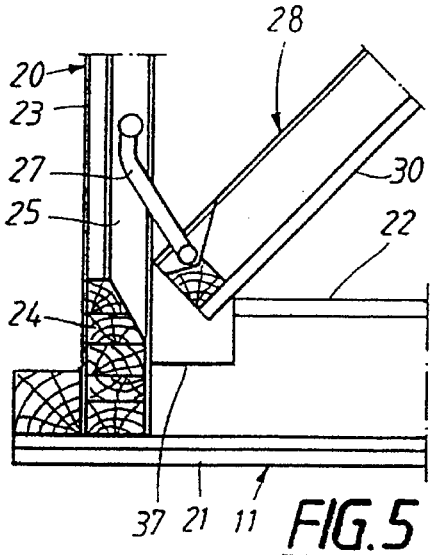
FIG. 5 is a partial sectional view illustrating the erection of a side-wall.
Figure 6:
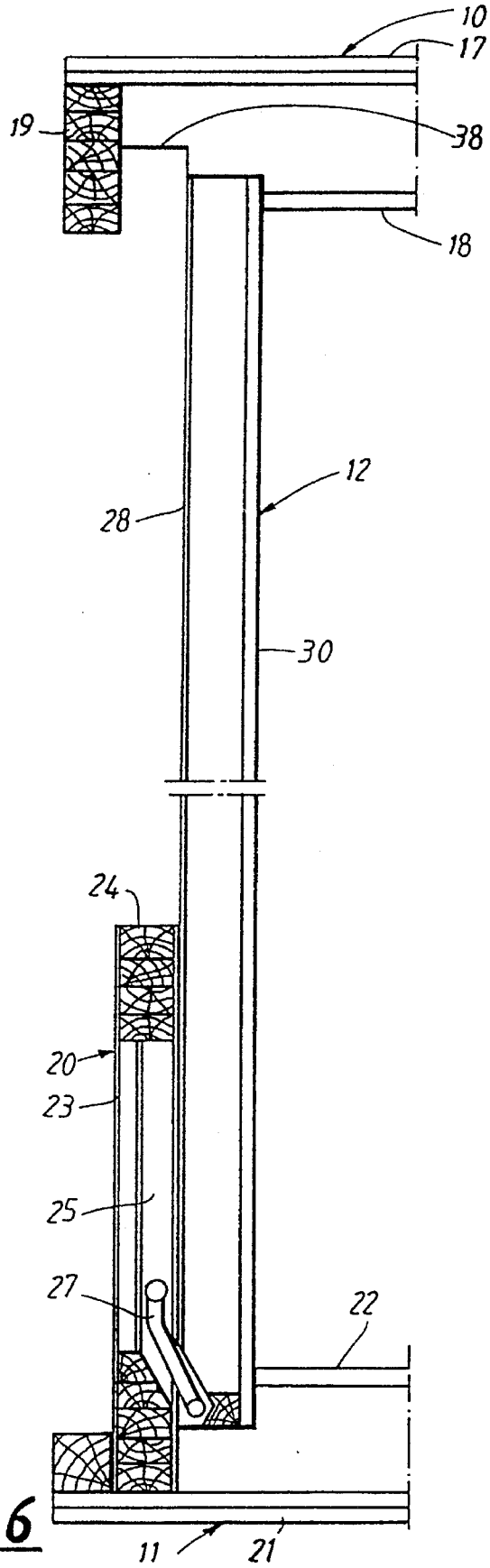
FIG. 6 shows the wall after finished erection.

FIGS. 4 to 6 illustrate how the link members 27 run in the rails 25 during erection from transportation position to use position.

Figure 8:
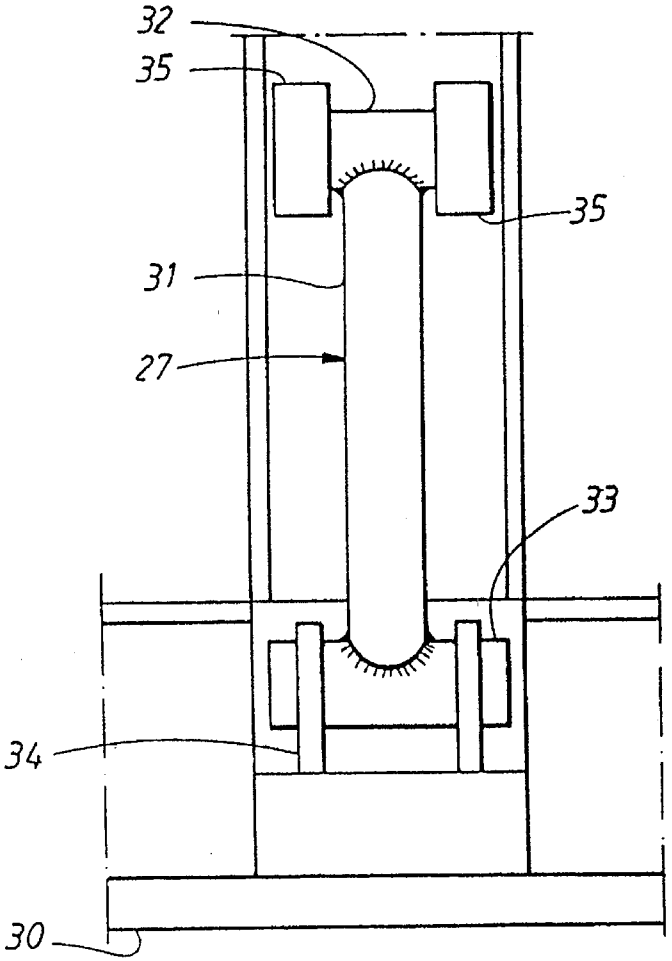
FIG. 8 in a corresponding way shows the link member in a front elevation.
Figure 7:
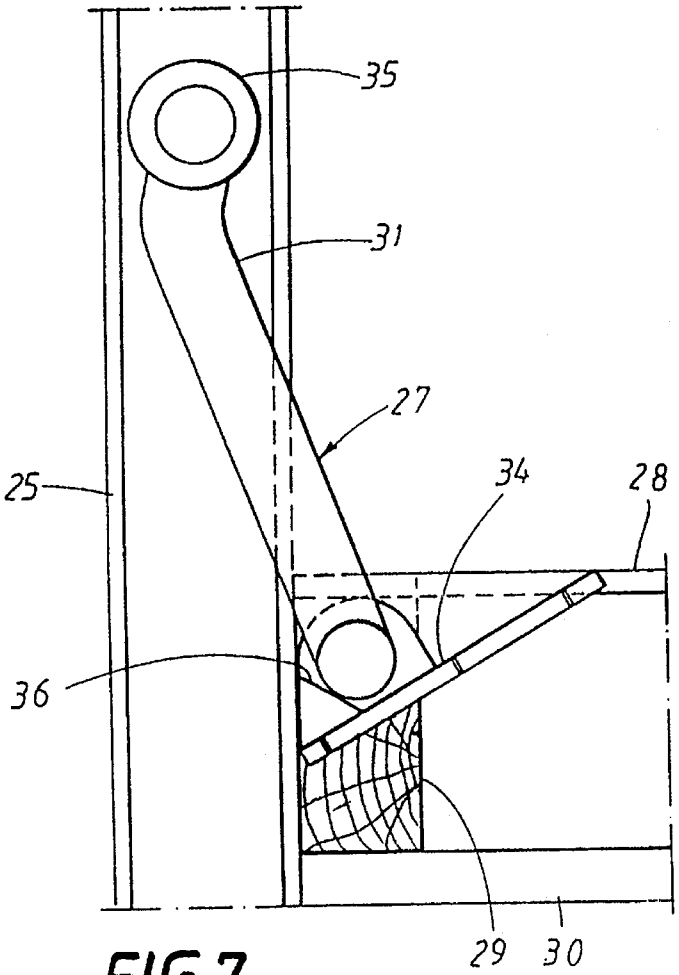
FIG. 7 in a larger scale shows one of the link members of the container in a side elevation.

FIGS. 7 and 8 show a link member at a larger scale, and it is seen that it comprises an elongated lever 31 which forms an angle and which at each end is connected with a cross-piece 32 and 33, respectively. The cross-piece 33 is rotatably mounted in a mounting 34 at the lower edge of the wall. The other cross-piece 32 is provided with friction reducing rolls 35, which run in the rail 25. The mounting 34 has an angle stop 36, which prevents the link member from swinging beyond a certain angle position relative to the wall so that false handling is avoided during the erection of the wall.

When the walls are erected, first the long sides 12, 14 are swung up vertically towards the inner side of the floor frame 20. Thereafter they are lowered into recesses 37 in the bottom portion 10. The short side-walls 13, 15 are erected correspondingly. The four walls are secured to each other by means of hook members, not shown, which are manouvered to their locking positions by means of a simple tool, e.g. a hex key. Finally the cover member 10 is lowered over the four walls until the walls rest in corresponding recesses 38 in the cover member 10, whereafter the cover member is secured to the walls by means of hook members corresponding to the above described hook members.

Sealing strips 39, 40, see FIGS. 2 and 3, are used for sealing the gaps between the walls in the corners, and for sealing the gap between the walls and the upper edge of the frame 20 of the bottom member, respectively. These sealing strips may also be placed in recesses and protected in surfaces of the walls facing each other.

The invention is not restricted to the above described examples of embodiments, but several modifications are conceivable within the frame of the appending claims. The bottom member of the container need not for example be square but can also have other shapes. A plurality of containers according to the invention can be coupled together to a large unit, for example to be used as a school or as a hospital.

I claim:

1. A foldable container comprising:

a substantially planar floor, the floor having an upper surface, a lower surface and side edges between the upper and lower surfaces;

a frame member extending transversely away from the floor along the side edges of the floor;

a roof;

at least two substantially planar side walls;

at least one link member connecting each of the side walls to the frame, each link having a first end pivotally connected to a side wall and a second end pivotally connected to the frame, the link also being slidably connected to at least one of the side wall and the frame so as to allow the link to move linearly relative to said at least one of the side wall and the frame;

whereby the pivotal and slidable connections of the side wall to the frame via the link allows the side wall to be moved from a collapsed position wherein the side wall is substantially parallel with the floor to an upright position wherein the side wall is substantially transverse to the floor and aligned with the frame; and the pivotal and slidable connections further allowing the side walls to move in a linear direction with respect to the frame when the side wall is aligned with the frame so that the side wall can be moved into a position whereby the frame provides side support to the walls when the walls are in the upright position.

2. The foldable container of claim 1, wherein each of the side walls includes upper and lower edges having a predetermined thickness and wherein the floor includes a plurality of recesses located proximate the frame member, each recess having a predetermined thickness that allows the side wall to be received within the recess when the side walls are in their upright positions.

3. The foldable container of claim 1, wherein one end of each link member is slidably received in a rail provided in the frame member.

4. The foldable container of claim 3, wherein the rail is linear such that the link member received therein is linearly displaced in the rail.

5. The foldable container of claim 1, wherein the frame member includes an upper edge spaced from the upper surface of the floor such that the frame and floor together define an open container; and wherein the roof has a plurality of side edges and a roof frame extending transversely from the side edges such that when the side walls are in the collapsed position, the roof frame and frame member together with the floor and roof encase the side walls within the open container formed by the floor and frame.

6. The foldable container of claim 1, wherein the floor and roof are each provided with recesses adapted to receive the side walls when the side walls are in the upright position such that in the upright position, the side walls overlap the roof and the floor.

7. The foldable container of claim 1, wherein the floor, roof and side walls are provided with interior insulation.

8. The foldable container of claim 1, wherein the first end of each link has a fixed pivotal connection to a side wall and the second end of each link has a slidable pivotal connection to the frame member and wherein the length of the link between the pivot connections is fixed.

9. The foldable container of claim 1, wherein the link is inextensible.

10. The foldable container of claim 1, wherein each side wall includes a lower edge and recesses are provided in the floor for receiving the lower edges of a side wall when the side wall is in the upright position such that in the upright position the lower edge of the side wall is received in a recess provided in the floor and a portion of the side wall spaced from the lower edge is supported by the frame.

* * * * *